United States Patent [19]

Wolf et al.

[11] 4,426,188

[45] Jan. 17, 1984

[54] FORK CONSTRUCTION FOR FORK LIFT TRUCKS

[75] Inventors: Theodore L. Wolf, Southington; John A. Rossman, Mentor; Russell C. Quinn, Twinsburg; Thomas J. Kish, Mentor, all of Ohio

[73] Assignee: Jos. Dyson & Sons, Inc., Eastlake, Ohio

[21] Appl. No.: 889,431

[22] Filed: Mar. 23, 1978

[51] Int. Cl.[3] ..... B66F 9/14

[52] U.S. Cl. ..... 414/667; 294/67 A; 294/82 R; 403/328; 403/330; 414/785

[58] Field of Search ..... 214/731, 750; 294/67 A, 294/82 R; 403/95, 108, 325, 328, 330; 414/667, 671, 785

[56] References Cited

U.S. PATENT DOCUMENTS

| | | | |
|---|---|---|---|
| 2,545,813 | 3/1951 | Jackson | 403/325 |
| 2,940,626 | 6/1960 | Ulinski | 214/750 |
| 4,002,256 | 1/1977 | Kroboth | 214/750 X |

*Primary Examiner*—Robert G. Sheridan

*Attorney, Agent, or Firm*—Frank B. Robb

[57] ABSTRACT

A fork for a fork lift vehicle, which is formed with an integral head, created by forging the same, into a hooked shape form, the rest of the fork being of generally conventional configuration, the fork further including special devices to effect latching of the same in position for use and to make positive the positioning and release of the fork for movement into various transverse positions with respect to the vehicle.

6 Claims, 25 Drawing Figures

FORK CONSTRUCTION FOR FORK LIFT TRUCKS

BACKGROUND OF THE INVENTION

While the use and general form of forks for fork lift vehicles is well known, and a number of different methods of making the same have been availed of, including fabrication as well as forging, the difficulty heretofor has resided in the formation and provision of the main supporting hook portion of the fork, to connect the same to a vehicle and to bear the load, without rupture, this having heretofor been provided by means of a part with a hook element formed therewith welded to the upper end of a fork, in some manner with latch means extending through such member, the fork being supported on a transversely extending rail with notches therein, the latch member being availed of for locking and release permitting movement of fork transversely of the vehicle, forks customarily being used in pairs.

The problem with regard to the latch members, has been that they have usually been in the form of bolt elements, slidable upwardly and downwardly and maintained in position by a spring, the lower end of the bolt engaging a notch on the transverse rail. However the bolt has not heretofor been in position to fully engage with the notch and maintain the same in a completely positive position.

Usually such bolt arrangements are offset enough from the notch so that they do not fully engage the faces of the notches in their respective positions when the fork is positioned on the rail. Movement of the bolt member upwardly under spring pressure will permit movement of the fork but the problem of full engagement of the end has not heretofor been solved.

The inner faces of the notch or notches as the case may be which are formed in the rail upon which the fork is supported, become deformed from use and because of the round shape of the bolt as well as other factors, which interferes with the operation by the operator of the fork for movement from notch to notch along the rail, the deformation causing difficulty in movement of the fork and improper or incomplete engagement of the usual bolt member provided.

Additionally the forms of latch members availed of, have caused many problems, including the difficulty which arises because of rust and other foreign particles surrounding the bolt member per se which will often cause the bolt to become lodged in one position or the other and difficult to release for movement of the fork along the rail as indicated. It is noted that a lower rail is used in conjunction with the upper rail to maintain operative position of the fork, the lower rail not bearing the main weight of the load being carried by the fork or forks as the case may be.

The advantage of availing of a forged head for the fork involving the hook element thereof, will be apparent when it is understood that many of the new regulations and rules relating to safety of vehicles and elements thereof, are not easily met entirely by usual welding processes, which produce connections subject to fracture and to destruction under adverse conditions although not always though the possibility exists and is to be avoided. By availing of forged construction such as is here disclosed, this can largely be overcome if the fork is made in accordance with this invention.

OBJECTS OF THE INVENTION

It is a principal object of this invention to provide a forged fork, in which all of the essential load carrying aspects thereof are forged, including the hook upon which the entire fork is suspended from the vehicle, forging effecting vastly greater strength, and by the forging process according to the disclosure here carry the load through the hook at the support end of the fork.

A further object of the invention is to form the hook or head end of the fork by forging in steps which have been carefully calculated and the contours determined so that the ultimate form of fork will have the greatest strength suitable for the purposes and of a uniformity throughout in accordance with the best practice.

Another object of the invention is to provide a forged head fork, in which a latch member can be incorporated which will overcome heretofor outstanding objections including difficulties in manipulating the same and reducing the tendency to seizing so that transverse movement of the fork is difficult, but which will not be the case in the disclosure hereof.

Another object of the invention is to provide a novel form of latch structure in which the latch is readily manipulable, so that the same may be released from its position of engagement with a notch and be mounted in the forged head of the fork, in an opening which does not materially reduce the strength of the head, being provided with means of novel form to maintain the latch out of notch engaging position.

Other and further objects of the invention will be understood from a consideration of the specification appended hereto and disclosed in the drawings wherein.

Figure 6:
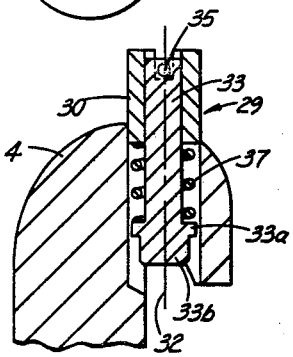
FIG. 6 is a fragmentary sectional view of one form of latch structure in accordance with this invention illustrating same as though in notch engaging position.
Figure 9:
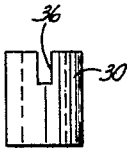

FIG. 9 discloses one of the latch parts of FIG. 6 in side elevation.

Figure 10:
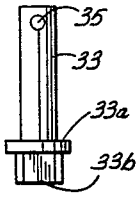

FIG. 10 is a view in side elevation of the bolt of the latch disclosed in FIG. 6.

Figure 11:
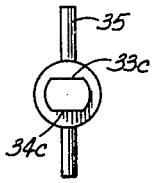

FIG. 11 is a bottom view of bolt of FIG. 10.

Figure 12:
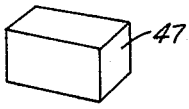

FIG. 12 illustrates a magnet member used in the latch structure shown in FIGS. 13 to 16 inclusive.

Figure 13:
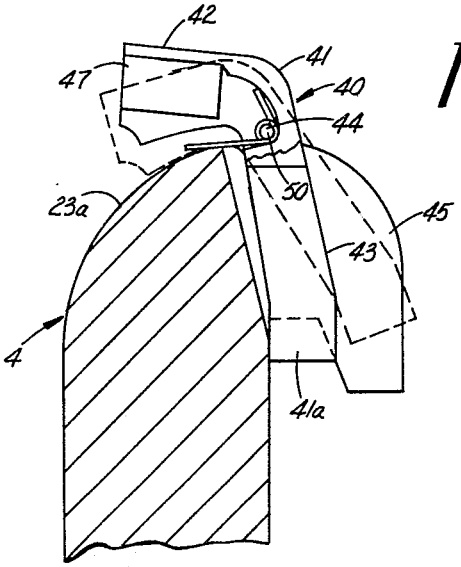

FIG. 13 discloses in fragmentary sectional view, a novel form of latch of lever shape and its associated related parts.

Figure 14:
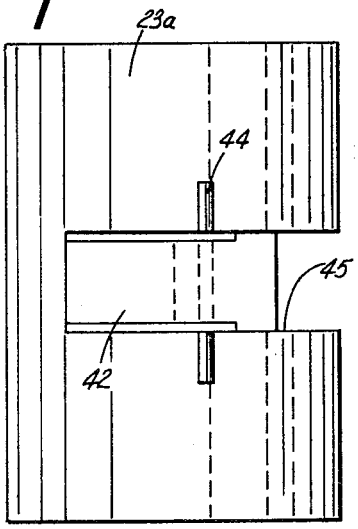

FIG. 14 is a top plan view and shows the head of a fork with the latch structure of FIG. 13 incorporated therein.

Figure 15:
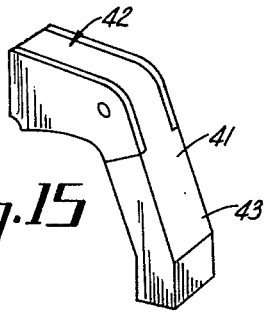

FIG. 15 illustrates the latch member in perspective.

Figure 16:
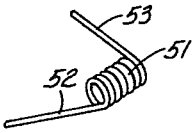

FIG. 16 is a perspective view of a spring used in the latch structure of FIG. 13.

Figure 17:
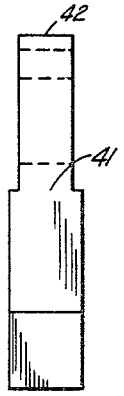

FIG. 17 is a front elevational view of a part of the latch availed of in FIG. 13.

Figure 18:
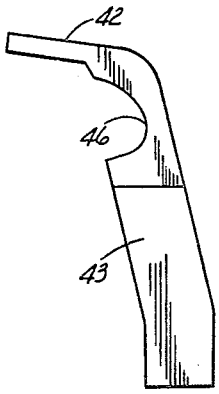

FIG. 18 is a side view of the latch part of FIG. 17.

Figure 19:
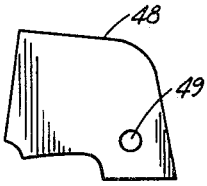

FIG. 19 discloses a pair of plates to be used at each side of the magnet availed of in the latch shown in FIG. 13.

Figure 19A:
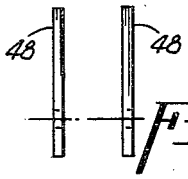

FIG. 19*a* is a side view of the plates of FIG. 19.

Figure 20:
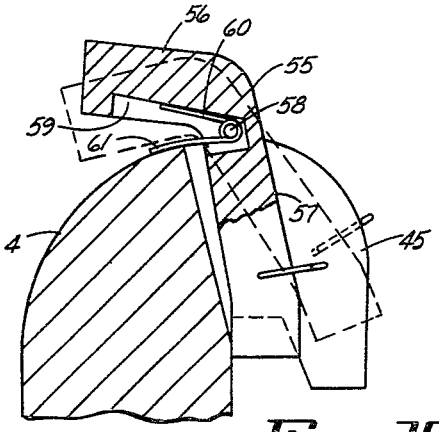

FIG. 20 is a fragmentary sectional view, showing another form of latch suitable for substituting in the disclosure of FIGS. 13 and 14.

Figure 21:
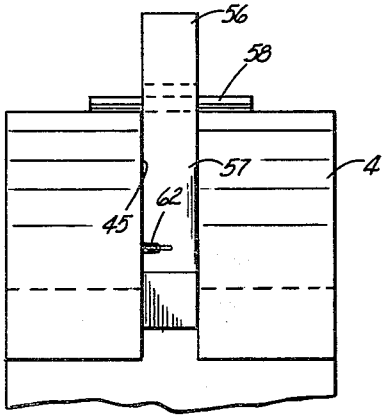

FIG. 21 is a view from the right hand side of FIG. 20 showing the latch therein in position prior to movement out of latched position.

Figure 22:
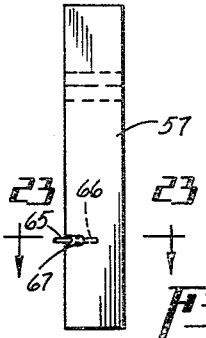

FIG. 22 shows the latch structure of FIG. 20 as though removed from the head.

Figure 23:
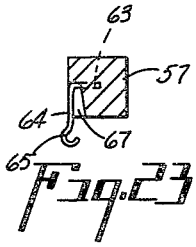

FIG. 23 is a fragmentary view sectional taken above the line 23—23 of FIG. 22 looking in the direction of the arrows to show a stop member in position.

Figure 24:
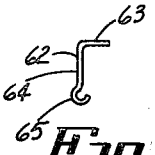

FIG. 24 is the stop member availed of in FIG. 23.

DESCRIPTION OF THE INVENTION

Figure 1:
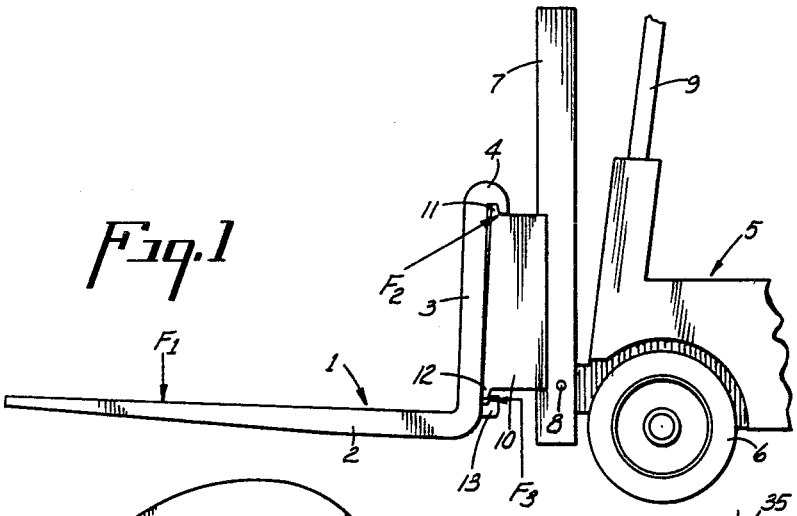
FIG. 1 is a fragmentary view somewhat diagrammatic in nature illustrating a fork or forks of the construction hereof as positioned on a fork lift vehicle.

Referring now to FIG. 1, a fork of typical configuration is generally designated 1, including the load bearing arm 2 and the support arm 3 thereof, with the head 4 forged integrally with said previously named arms, the fork in position on a lift vehicle generally designated 5.

The lift vehicle 5 includes the usual forward support wheels 6 and suitable wheels at the opposite end not disclosed but which can obviously be supplied by those skilled in the art.

A mast structure 7 is supported on the forward portion of the vehicle 5 and adapted to be tilted around a pivot such as 8 toward and from the fixed mast 9 on the vehicle, the mast 7 in turn supporting for up and down movement, a carriage such as 10 which has extending there across a rail 11 at its upper portion and at its lower section another rail 12 spaced from the rail 11.

The fork 1 includes a lower hook element 13 to engage the rail 12 so that the fork 1 as a whole may be slid along the rails 11 and 12 and maintained in connection with the vehicle 5.

Figure 2:
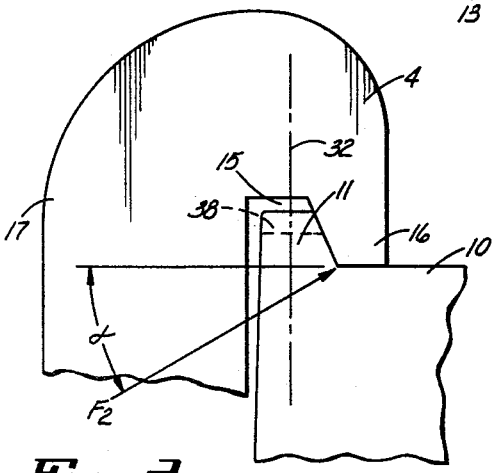
FIG. 2 is a fragmentary view in elevation showing the general configuration of the head of a fork in its engaged position.

Turning now to a consideration of FIG. 2, the rail 11 is shown on the upper portion of the carriage 10, engaged by the head 4 having a groove 15 formed by the lip 16 and the body portion 17 of the support arm 3.

This groove 15 is a downwardly open groove and the lip 16 extends downwardly so as to be generally parallel with the support arm 3 and specifically the section 17 at the upper end thereof.

Figure 3:
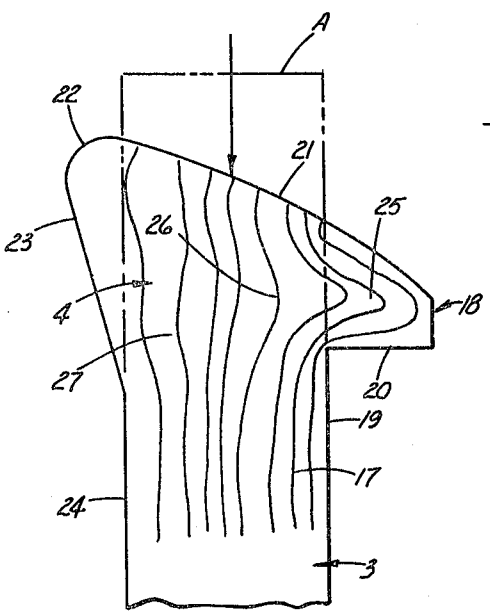
FIGS. 3, 4 and 5 illustrate the cross-sectional form of the head of the fork, as it progresses through the forging steps set forth herein, including the gathering or upsetting bending and ultimate forming and bending positions with the head in final form illustrating the desired grain structure and finished shape.
Figure 4:
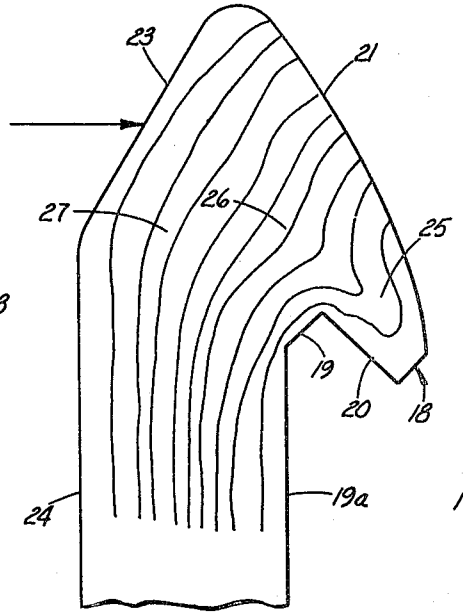
Figure 5:
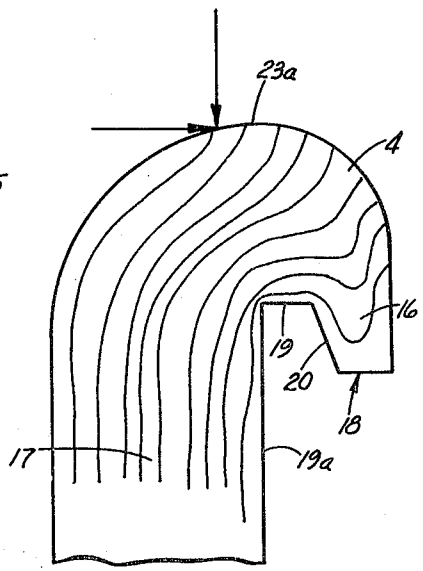

Turning now to a consideration of FIGS. 3, 4 and 5, the formation of the head or hook end 4 of the fork 1 is disclosed in detail and particular reference is made to the grain structure thereof, noting that the portion 17 of the fork comprising the upper end and thereby forming the body thereof, which in its first forging stage, is caused to be upset or gathered from a bar blank A, as shown in FIG. 3, to include an offset 18, formed so that the angle including the face 19 of the section 17 and the lower portion or surface 20 of the offset 18 is substantially a right angle and extends across the width of the fork head 4.

The upper surface or extremity of the head now being described, is formed in arcuate almost semi-circular form by a suitable die and designated at 21 with the reverse bend 22 extending downwardly and inwardly to surface 23, to the outer surface 24 of this section 17.

It will be noted that the portion 22 extends outwardly beyond the surface 24 nearly opposite the offset 18 previously mentioned.

It will also be essential to note the manner in which the grain structure, follows line generally designated 25 and 26 with others designated 27 to extend through and be effected by this gathering and forming operation initially disclosed in FIG. 3.

Subsequently the step disclosed in FIG. 4 is taken, in which further bending of the whole upper section takes place, so that surface 19, and the surface 20 are still maintained in their right angle relationship, but bent substantially with regard to the face portion now designated 19*a*, the whole head previously mentioned being moved into the position disclosed with the surface 23 now angling inwardly instead of outwardly and the surface 21 being more angularly, downwardly disposed likewise with the surface 24 being maintained in its initial position.

The grain suggested by lines 25, 26 and 27 are observed as being similarly distributed as before and following the general bending of the head into the position shown in this FIG. 4 disclosure.

The final operation of forming and ultimate bending is shown in FIG. 5 wherein the offset 18 is now the lip element 16 of the hook or head 4 with the surface 20 having been angularly changed with regard to surface 19 so as no longer to comprise a right angle but instead the right angle is now established between the surfaces 19*a* and 19 instead.

It will also be noted that the upper surface of the head 4 now designated 23*a* has assumed a generally semicircular form, with the lip element designated 16 extending downwardly therefrom and the grain flow lines being maintained and carried therethrough so that the structural strength of the head 4 provided by the forging operation is available, and integrally connected by grain lines with the body 17.

It will be understood that the grain flow pattern illustrated, is in fact that which prevails in accordance with the disclosure here, to effect the greatest strength possible in a fork of this nature and to provide continuous lines of strength therein to withstand load applied thereto as suggested in FIG. 1 by the forces indicated at F 1 and F 2 and arrows associated therewith.

It should be noted that this contour and configuration as well as the steps hereinbefore outlined, have been carefully determined to cause the grain to follow the form of the head as described to make an integral fork with the head or hook portion as strong as the rest of the fork in any event.

Turning now to a consideration of other figures in the drawings, a latch structure as shown in FIG. 6 generally designated 29 is provided, and mounted in the head 4 substantially differently from that normally availed of.

In this particular form, a guide element 30 shown in detail in FIG. 9, is provided and mounted in the head by any preferred means by such as welding or the like, this guide being of tubular form, and having its axis mounted on the line suggested at 32 in FIG. 6, in the opening 31 noted therein.

Figure 7:
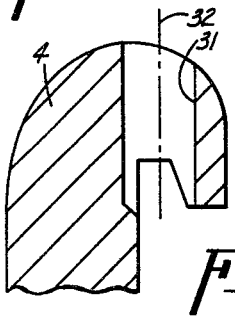
FIG. 7 is a fragmentary sectional view of the head of a fork before mounting of the latch structure shown in FIG. 6.

The opening 31 and the axis 32 thereof, are arranged differently from the normal type of hook element, which is usually welded onto the base such as 19 of the hook referred to in FIG. 3, and prior to any other operation or in the finished operation so that the axis of an opening in a hook is substantially rightwardly of that disclosed in FIG. 7.

The purpose of arranging the opening 31 in the head 4 of FIG. 7 with its axis as shown, is in order to enable the complete transverse engagement of a latching member such as will now be described and referring again to FIG. 6.

As noted in FIG. 6, the guide member 30 is provided with a bolt 33, shown in detail in FIG. 10 as being a rod like part basically, having at its lower end however a shoulder 33*a*, the end portion 33*b* thereof, being formed as suggested in FIG. 11 with flats 33*c* and 34*c* formed thereon.

The upper end of the member 33 is provided with a transverse pin 35, which is arranged to provide for manipulating the said bolt like part 33, into and out of a notch such as 36 formed in the guide 30.

A spring 37 surrounds member 33 between the guide 30 and shoulder 33*a*, normally maintaining such member in downward position when handle 35 is aligned with notch 36. Shoulder 33*a* acts as a guide in opening 31 and maintains portion 33*b* in against a rail notch for alignment and opposing thrust directed to the fork head during fork use.

Similarly when the handle 35 is raised upwardly and turned at right angles to that position shown in FIG. 6, the member 33 and its latch engaging portion 33*b* thereof will be maintained out of engagement with the notch.

Figure 8:
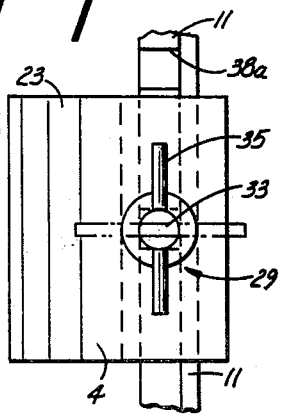
FIG. 8 is a top plan view of a latch as in FIG. 6.

The engaging position of the notch, as suggested in FIG. 8, with regard to notches spaced along the rail 11, these notches being designated 38 and including the sides 38*a*, which are arranged so that they will respectively receive therebetween the flats 33*c* and 34*c* of the member 33 when that member is in its lowered position, and thus the full notch width of the rail 11 is engaged by said flats 33*c* and 34*c* with alignment being provided which would otherwise not be possible if it were not for this type of arrangement and particularly if it were not for the fact that the head 4 is forged, and thus makes possible in a sense the insetting of the latch structure 29 generally speaking.

It will thus be apparent that by raising on the handle 35, the bolt 33 will be withdrawn from a notch such as 38*a* and thereafter the fork 1 may be moved transversely of the vehicle.

In FIG. 13, a completely different form of latch structure is disclosed, in this instance being generally designated 40, and essentially comprising an inverted L-shaped member generally designated 41, which is able to be reciprocated back and forth by reason of the fact that in inverted condition it may be pivoted about the juncture of the arms 42 and 43 on pivot 44, the pivot as shown in FIG. 14 being suitable affixed to the upper surface 23*a* of the hook or head 4.

The head or hook 4 of the fork now being described is suitably slotted as indicated in FIG. 13 at 45 to receive the latch member 41 and that the member 41 may be manipulated to assume the dotted line position disclosed therein, from the full line position in which complete engagement of the lower end 41*a* in a notch such as 38*a* of the rail 11 previously mentioned is effected.

The construction of the latch member 41 should be described at this point, and reference is therefore made to FIGS. 17 through 19*a*, wherein is disclosed the lever 41 as before suggested with the arm as shown in FIG. 18 designated 42 being formed with a notched out area at 46, the other arm being designated 43 as will be recalled, and the portion 42 as indicated in FIG. 17 being somewhat narrower than the portion 43.

The reason for this construction is to enable the arrangement of a magnet such as is suggested in FIG. 12 being generally rectilinear in configuration and designated 47, to be mounted in the arm 42, and to this end the side plates designated 48 of identical configuration are availed of, including in each case the pivot opening 49 therein.

Turning now to FIG. 13 again, it will be seen that with the magnet 47 in position, and the side plates 48 applied to the portion 42 of the lever 41, that the magnet is thereby positioned, the plates and magnet being maintained in connection with the body 41, by means of suitable epoxy material or the like.

It should be further noted that the body 41, is formed of non-magnetic material, and the plates 48 are of iron or steel or the like magnetic type material to add to and enhance the magnetic properties of the magnet 47.

Referring to FIG. 13 again, the latch unit 40 is mounted on a pivot 50, a spring 51 surrounding the same and within the cavity 46, with one arm 52 adapted to engage the surface 23*a* and the arm 53 of said spring the interior surface of the cavity 46.

It will thus be apparent that without more when the latch structure is shown in the position of FIG. 13, the spring 51 will maintain the latch in that position and in engagement with the notch as desired the notch being numbered 38*a* as will be recalled.

When it is desired to move the latch 41 into the position as shown in dotted lines in FIG. 13, suitable pressure applied to the arm 42 will effect such movement and the magnetic attraction of the magnet 47 and its associated plates 48 will in engagement with the surface 23*a* will maintain the said latch in its out of engagement position so to speak.

It will be obvious that suitable manipulation of the latch may be resorted to and yet spring pressure may normally be applied when the magnet is out of engagement, so that movement of the fork and head 4 thereof along the rail will facilitate spring engagement of the latch end 41*a* with a suitable notch 38*a* when properly positioned with relation thereto.

By the same token the magnet 47 will maintain the lever out of engagement with a notch so that movement of the fork may be resorted to along the rail 11 to any desired position.

Another form of latch is disclosed in FIGS. 21 to 24 inclusive, and is of generally the same configuration as the latch just described and noted at 40, in this instance however the latch member itself being designated 55, is of similar L-shaped inverted configuration, including an arm 56 and an arm 57, the entire unit being pivoted about a point 58 about at the juncture of said arm.

In this instance the arm 56 is hollowed out at 59, so as to conceal a spring 60 therewithin, the spring in this instance being substantially of the same form as the spring shown in FIG. 16 and denoted 51, including the arm 60 and 61.

It is understood that the normal action of the spring 60, is to maintain the member 55 in the full line position shown in FIG. 20.

In order to maintain the latch in the dotted line, latch member 55 in the dotted line position in FIG. 20, a suitable stop member 62 is provided having an arm portion 63 and another portion at right angles 64 terminated in a head 65, this member being formed of wire, round wire preferably.

The stop member 62, is arranged to be inserted in a suitable opening formed in the arm 57 and designated 66, and rests in a groove 67 formed in the side of said arm 57 so that the arm will be able to move inwardly and outwardly in the groove 45 of the head 4.

The end 65 being designated the head of the stop member 62, extends beyond the arm 57 as suggested in FIG. 20 so that when the latch member 55 is moved into the dotted line position, the head will extend outwardly beyond and engage the edge of the notch 45 or notch or groove 45.

Since this is a resilient body, by suitable manipulation of the arm 56, the latch member as a whole may be caused to resume its full line position, bending slightly the resilient body of the stop member 62 as suggested in the figures by reason of the positions of the respective elements described and particularly as suggested in FIG. 1 where the latch member 55 is in the full line position as indicated in FIG. 20.

It must be apparent that either of these latch members may be substituted for the other without modification of any substantial nature.

It is of course obvious that by manipulating the latch member 55 into the respective positions shown in FIG. 20 that the fork as a whole may be positioned with regard to a notch on the rail 11, or permitted to move along said rail and subsequently again engage another notch all in accordance with preferred practice.

The provision of the latches of the several constructions disclosed, substantially reduces the potential for injury in the use of the forks, since in each of the forms described, the lift truck operator can move the fork with the latch in completely disengaged position, adjust the fork close to the location desired with the latch under spring tension and when further movement is effected the latch will snap into complete notch engagement.

The operator can use both hands to move the fork and need not use one hand to maintain a latch out of notch engaging position reducing probability of injury to hands and fingers.

We claim:

1. A fork for a fork lift vehicle comprising a load arm, a support arm connected thereto and integral therewith, a head integral with the support arm to connect the fork to such vehicle, said head including a hook portion for interengagement with fork mounting means carried by said vehicle, said portion further comprising an integral, uninterrupted extension of the material of said arm, including the same material with grain flow therein following the contour of said head, through said hook portion, said fork being combined with a vehicle which includes a carriage thereon, said carriage including the mounting means, said mounting means comprising a transverse rail connected to the carriage and having a series of notches therein, the head being in engagement with the rail, and a latch member mounted in the head, said member having a portion in full engagement in one of said notches to prevent movement of the fork along said rail, a downwardly open groove is formed in the head at the rear thereof, said groove being engaged with the rail as stated, the notches are in the upper edge of the rail and extend at right angles across said rail, the latch member comprises a reciprocable member extending upwardly through the head, said member comprising an inverted generally L-shaped body pivoted at the juncture of the arms of said body, wherein the end of one arm may be moved into and out of engagement with a notch by manipulation of the other arm, a spring being positioned to exert pressure on said other arm to maintain the said end in engagement with said notch.

2. The combination as claimed in claim 1, wherein a downwardly open groove is formed in the head at the rear thereof said groove being engaged with the rail as stated, the notches are in the upper edge of the rail and extend at right angles across said rail, the latch member comprises a reciprocable member extending upwardly through the head, said member comprising an inverted generally L-shaped body pivoted about at the juncture at the arms of said body, whereby the end of one arm may be moved into and out of engagement with a notch by manipulation of the other arm, a spring being positioned to exert pressure on said other arm to maintain the said end in engagement with such notch, and means to maintain said member out of engagement with said notch.

3. The combination as claimed in claim 1, wherein a downwardly open groove is formed in the head at the rear thereof said groove being engaged with the rail as stated, the notches are in the upper edge of the rail and extend at right angles across said rail, the latch member comprises an inverted generally L-shaped body pivoted about at the juncture at the arms of said body, whereby the end of one arm may be moved into and out of engagement with a notch by manipulation of the other arm, a spring being positioned to exert pressure on said other arm to maintain the said end in engagement with such notch, and means to maintain said member out of engagement with said notch, said means comprising a magnet mounted on the said one arm whereby to co-act with the head of the fork to prevent the engagement.

4. The combination as claimed in claim 1, wherein a downwardly open groove is formed in the head at the rear thereof, said groove being engaged with the rail as stated, the notches are in the upper edge of the rail and extend at right angles across said rail, the latch member comprises an inverted generally L-shaped body pivoted about at the juncture of the arms with said body, whereby the end of one arm may be moved into and out of engagement with a notch by manipulation of the other arm, a spring being positioned to exert pressure on said other arm to maintain the said end in engagement with such notch, and means to maintain said member out of engagement with said notch, said means comprising a stop member mounted on the other said arm to co-act with the head of the fork to prevent the engagement, said stop member having a resilient body mounted on the other said arm and a head carried thereby said head engaging the edge of the said open groove to maintain the latch member out of engagement with the rail notches.

5. The combination as claimed in claim 1, wherein a downwardly open groove is formed in the head at the rear thereof, said groove being engaged with the rail as stated, the notches are in the upper edge of the rail and extend at right angles across said rail, the latch member comprises an inverted generally L-shaped body pivoted about at the juncture of the arms with said body, whereby the end of one arm may be moved into and out of engagement with a notch by manipulation of the other arm, a spring being positioned to exert pressure on said other arm to maintain the said end in engagement with such notch, and means to maintain said member out of engagement with said notch, said means comprising a stop member mounted on the other said arm to co-act with the head of the fork to prevent the engagement, said stop member having a resilient body mounted on the other said arm and a head carried thereby said head engaging the edge of the said open groove to maintain the latch member out of engagement with the rail notches.

6. The combinaion as claimed in claim 1, wherein a downwardly open groove is formed in the head at the rear thereof, said groove being engaged with the rail as stated, the notches are in the upper edge of the rail and extend at right angles across said rail, the latch member comprises an inverted generally L-shaped body pivoted about at the juncture of the arms with said body, whereby the end of one arm may be moved into and out of engagement with a notch by manipulation of the other arm, a spring being positioned to exert pressure on said other arm to maintain the said end in engagement with such notch, and means to maintain said member out of engagement with said notch, said means comprising a stop member mounted on the other said arm to co-act with the head of the fork to prevent the engagement, said stop member having a resilient body mounted on the other said arm and a head carried thereby said head engaging the edge of the said open groove to maintain the latch member out of engagement with the rail notches, the stop member being mounted in a groove formed in the other said arm and the head extending angularly with respect to the open groove in the head to effect the engagement described.

* * * * *